United States Patent [19]

Morris

[11] 4,432,151

[45] Feb. 21, 1984

[54] ADVERTISING DISPLAY APPARATUS

[76] Inventor: Stanley Morris, 13 Woodside Rd., Springfield, N.J. 07079

[21] Appl. No.: 403,575

[22] Filed: Jul. 30, 1982

[51] Int. Cl.[3] ..... G09F 3/18

[52] U.S. Cl. ..... 40/10 D; 211/78; 211/131; 40/493

[58] Field of Search ..... 40/505, 10 D, 358, 324, 40/107, 109; 46/1 L; 220/23.86; 211/131, 78

[56] References Cited

U.S. PATENT DOCUMENTS

| | | | |
|---|---|---|---|
| 165,147 | 7/1875 | Baldwin | 40/10 D |
| 2,000,419 | 5/1935 | Sarber | 40/10 D |
| 2,079,303 | 5/1937 | Pinner | 40/473 |
| 2,123,257 | 7/1938 | Provost | 40/324 |
| 2,610,421 | 9/1952 | Horn | 40/10 D |
| 3,561,146 | 2/1971 | Dembar | 40/10 D |
| 3,629,967 | 12/1971 | Bass | 46/1 L |
| 4,125,954 | 11/1978 | Barbieri | 40/107 |

FOREIGN PATENT DOCUMENTS

| | | | |
|---|---|---|---|
| 1196065 | 7/1965 | Fed. Rep. of Germany | 40/10 D |
| 1454427 | 10/1966 | France | 40/10 D |

*Primary Examiner*—Robert P. Swiatek
*Assistant Examiner*—Cary Stone
*Attorney, Agent, or Firm*—McCoy & Morris

[57] ABSTRACT

A display apparatus for displaying a plurality of advertisements comprising a base, which holds condiments and comprising a plurality of condiment holding sections separated from each other by the display apparatus, support members on the base for displaying a plurality of business cards with each of the business cards facing in a different respective direction. The cards are removably mounted and the display apparatus is mounted for movement relative to the base to change the direction in which a given business card faces. A transparent cover, removably mounted to the display apparatus, protects the business cards on the display apparatus and comprises a single integral member comprising a hollow, vertically disposed tube having four walls and having a rectangular horizontal cross-section. A plurality of vertically disposed support members or sections each facing in a different respective direction are protectively covered by the transparent tube. At least one business card is mounted to each support member. The support members are disposed on the inside of the tube, one support member facing each of the four walls of the tube. A resilient, strip-like member is located within the tube and is resiliently deformable between an expanded, open first condition and a second condition in which the strip-like member is at least partially closed for urging the advertisement on each support member toward its respective wall on the transparent tube. The apparatus is preferably displayed on restaurant tables so that customers can view the advertisements contained therein during their meal. The tube embodiment is of a size which preferably accommodates twelve business cards; three cards on each support member.

16 Claims, 9 Drawing Figures

FIG. 1
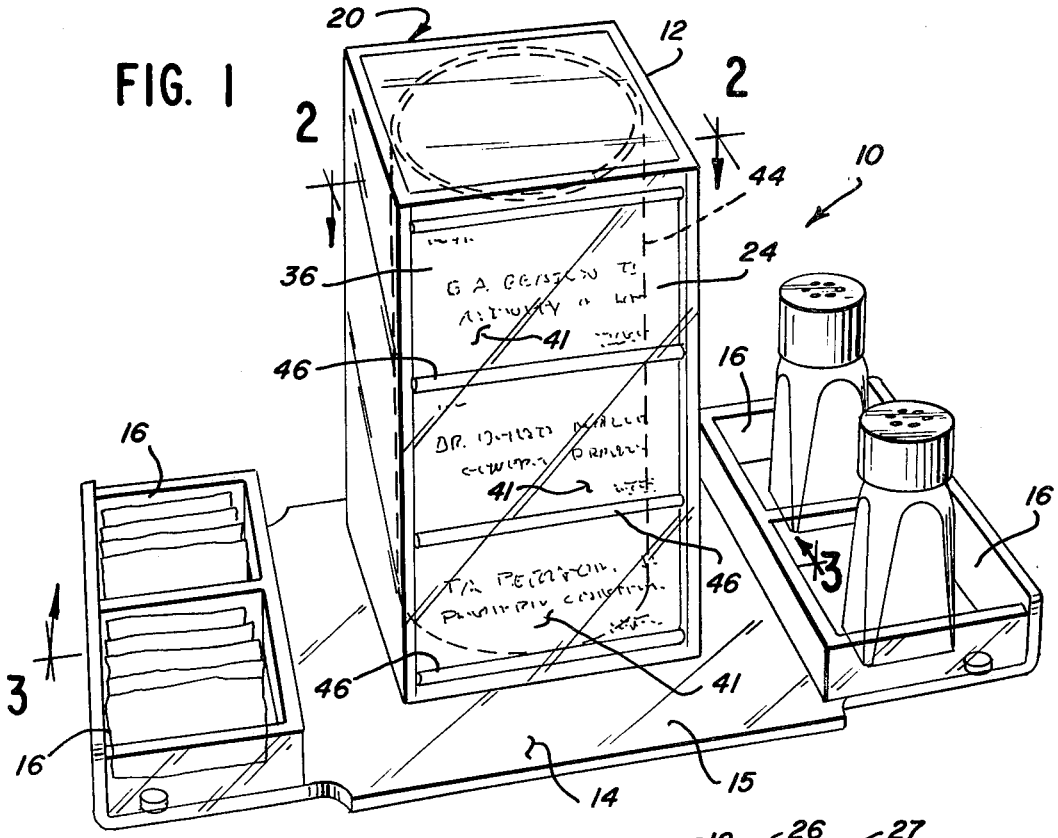
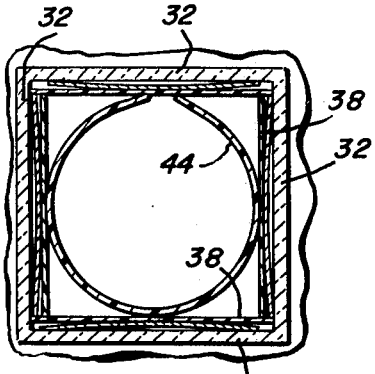
FIG. 2
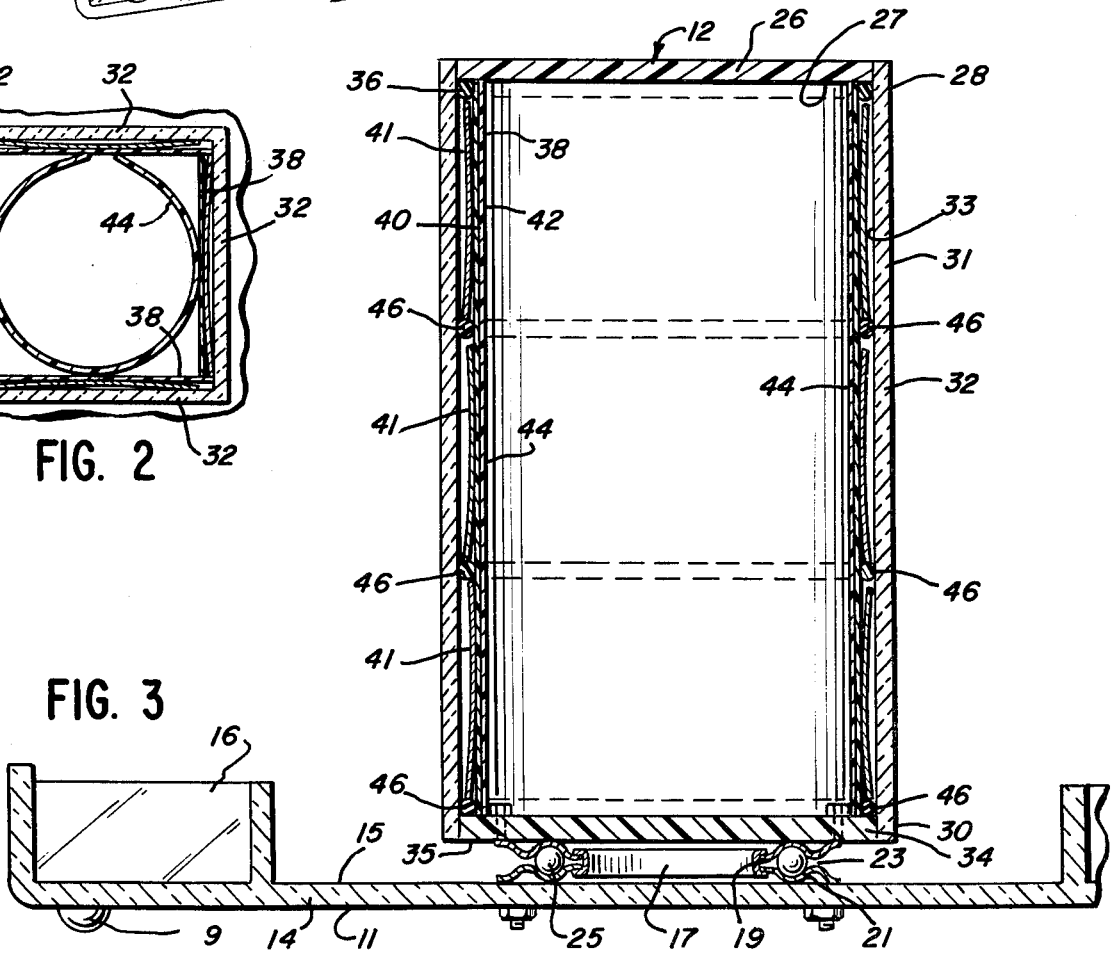
FIG. 3

FIG. 4
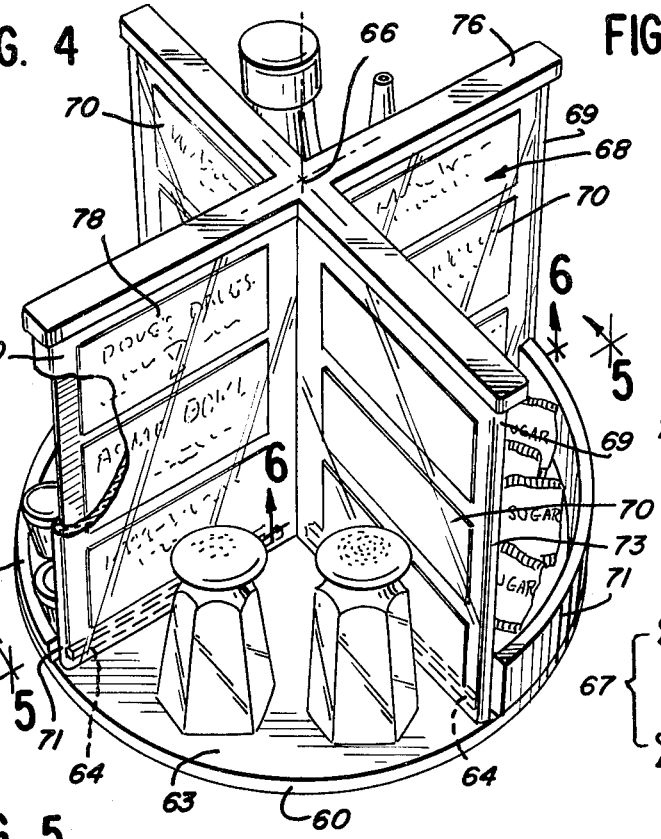
FIG. 6
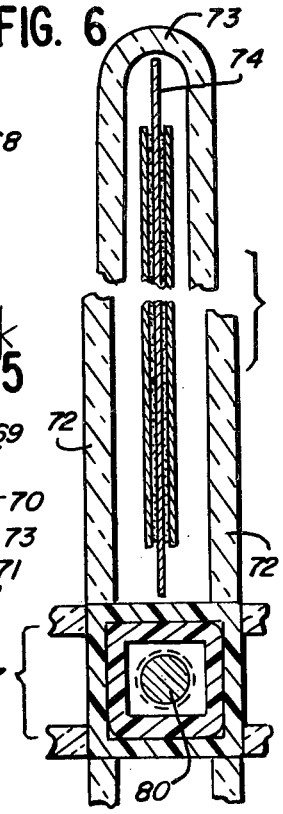
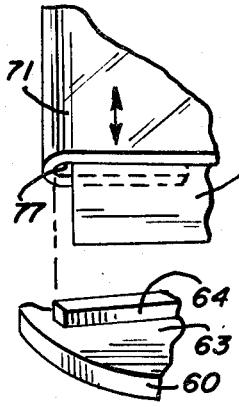
FIG. 7
FIG. 5
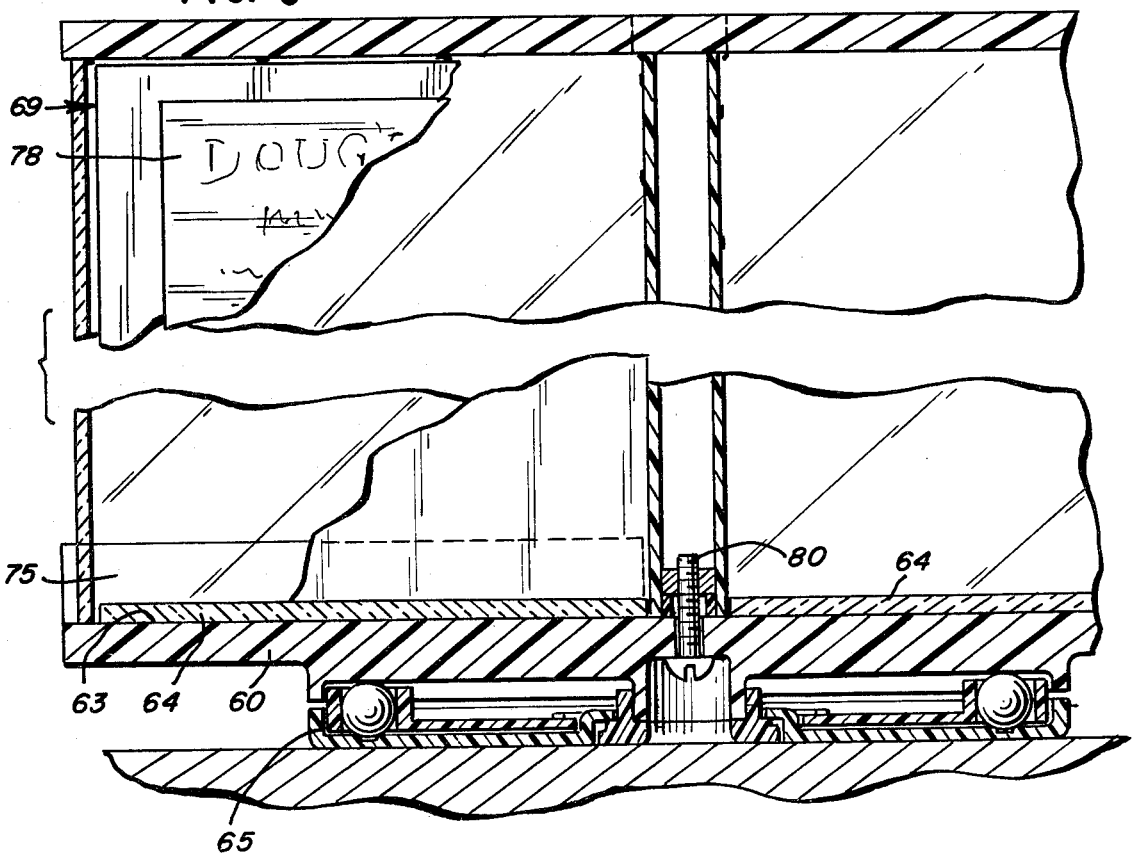

FIG. 8
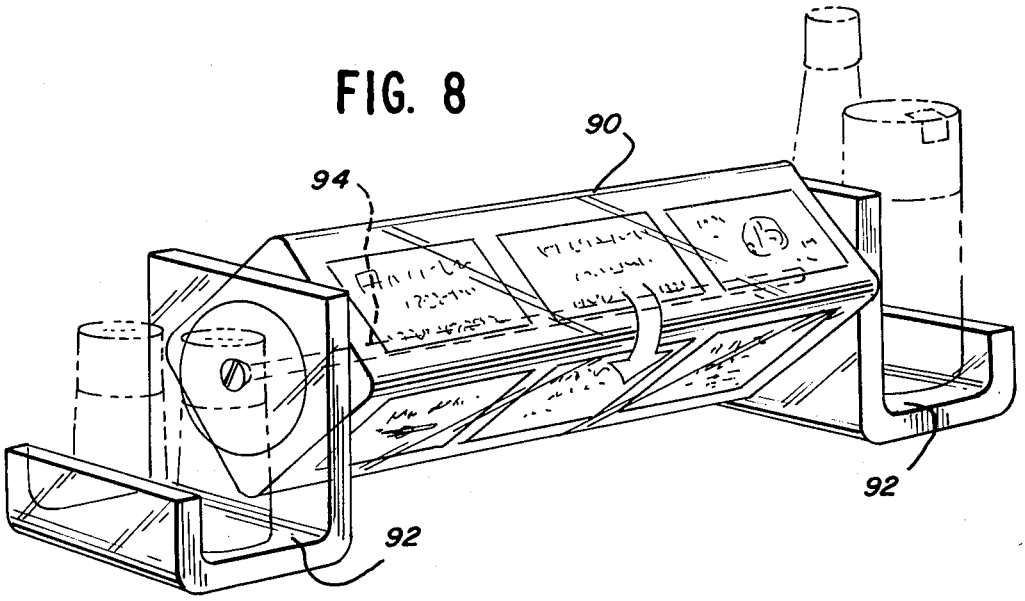
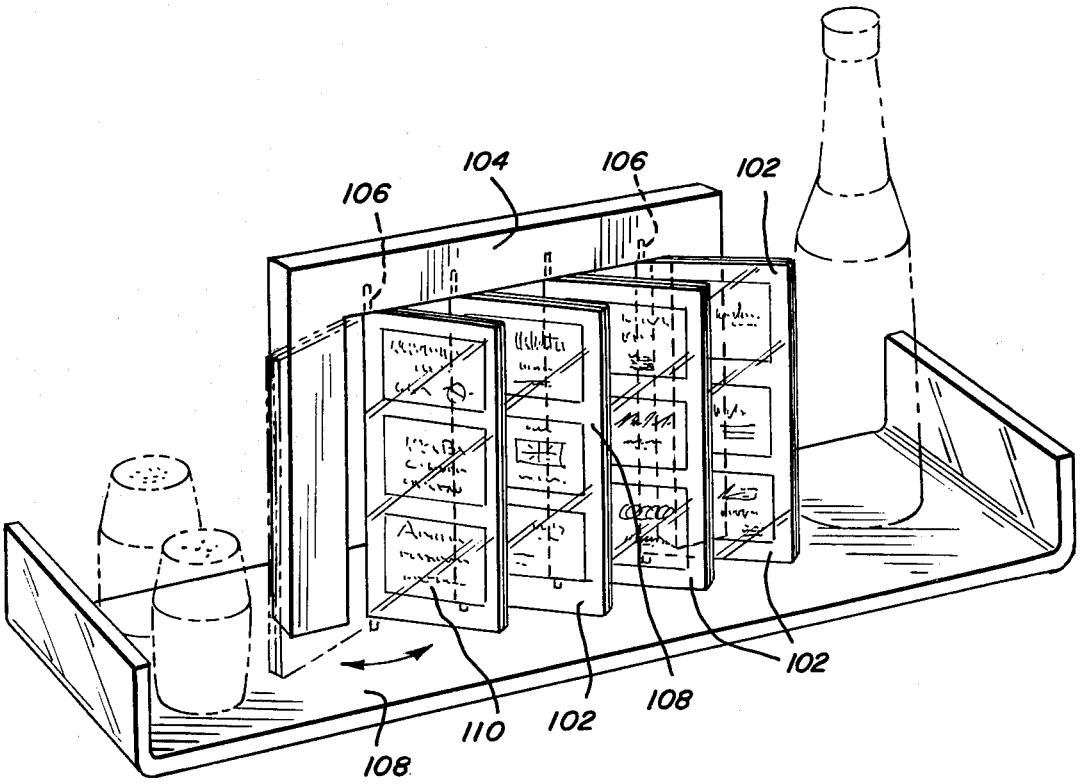
FIG. 9

ADVERTISING DISPLAY APPARATUS

BACKGROUND OF THE INVENTION

1. Field of the Invention

The apparatus of the subject invention pertains to an advertising display device with each set of advertisements facing in a different respective direction. The apparatus is preferably used on restaurant tables, so that the advertisements or menus can be viewed by customers during their meal.

2. Description of the Prior Art

Restaurant customers are a "captive" audiance for most types of advertisement media while they wait for and eat their food. It is not unusual to find on restaurant tables paper displays for soft drinks and the like, and even placemats containing information to read or puzzles to solve.

Nowhere has there been provided in restaurants an advertising display apparatus which compactly advertises the services and products of a plurality of businesses on each table. If such a devise were available, the "captive" audience would become a hugh market for products and services. Obviously, restaurant owners as well as the advertisers could greatly benefit from the use of such an apparatus.

SUMMARY OF THE INVENTION

An apparatus comprising means for displaying a plurality of advertisements or menus comprising a base, means on the base for holding condiments and comprising a plurality of condiment holding sections separated from each other by the display means, means on the base for displaying a plurality of business cards with each of the business cards facing in a different respective direction, means for removably mounting the cards and means mounting the display means for movement relative to the base to change the direction in which a given business card faces. Transparent cover means, removably mounted to the display means, protects the business cards on the display means and comprises a single integral member comprising a hollow, vertically disposed tube having four walls and having a rectangular horizontal cross-section. A plurality of vertically disposed support members or sections each facing in a different respective direction are protectively covered by the transparent tube. Means on each support member for mounting at least one business card to each support member. The support members are disposed on the inside of the tube, one support member facing each of the four walls of the tube. A resilient, strip-like member is located within the tube and is resiliently deformable between an expanded, open first condition and a second condition in which the strip-like member is at least partially closed for urging the advertisement on each support member toward its respective wall on the transparent tube. Mounting means attaches at least one business card to each support member. The apparatus is preferably displayed on restaurant tables so that customers can view the advertisements contained therein during their meal. The tube embodiment is of a size which preferably accommodates twelve business cards; three cards on each support member.

In another embodiment of the apparatus of the present invention the transparent cover means comprises four transparent sections each protectively covering one of four support members. The support members are arranged in a radial disposition from a common, centrally located vertical axis, each support member extending at a 90 degree angle relative to the two adjacent support members. The four transparent sections extend radially in the form of an "X" from a centrally located, vertically disposed axial portion wherein one of the cover means and one of the support members is removable relative to the other when the cover means is detached from the condiment holding means. Engaging means on the condiment holding means engage each of the cover sections at the bottom of the sections of fix the position of the cover sections on the condiment holding means. The cover means is detachably mounted on the condiment holding means and the condiment holding means is mounted for rotation about the vertical axis, relative to the base. The support members and cover sections have means mounting the support members for rotational movement with the cover sections when they rotate with the condiment holding means.

The "tube" and "X" embodiment of the invention may be used without the base condiment holding means. In the preferred embodiment of the apparatus each support member comprises three or four display sections. Each display section holds one business card. Thus, the apparatus is capable of simuultaneously displaying twelve or sixteen business cards. Any number of cards is theoretically possible to use with each support member; however, it is desirable to use no less than two cards, and nor more than four cards for each support member. In addition, a single card or advertisement or menu could be attached to a support member.

In the "tube" embodiment, the size of the base is approximately 12" long by 5-15/16" wide. The size of the tube is approximately 4" square by $6\frac{3}{4}$" high, using three cards per support member.

In the "X" embodiment, the condiment holding member has a diameter of approximately 8", and the transparent cover is approximately $7\frac{7}{8}$" in diameter. The height of the transparent cover is approximately $6\frac{3}{4}$" and each support member holds six cards.

The apparatus is reusable, lightweight, easily cleaned, simple in design, and economical to manufacture.

These and other advantages of the invention will become apparent to those of ordinary skill in the art with reference to the further detailed description of this invention.

DESCRIPTION OF THE DRAWING

FIG. 1 is a perspective view of the vertically disposed tube embodiment of the advertising display apparatus;

FIG. 2 is a sectional top view along Line 2—2 of FIG. 1 disclosing the top end of the tube;

FIG. 3 is an elevational, partial-cutaway sectional view along Line 3—3 of FIG. 1;

FIG. 4 is a perspective view of the "X" embodiment of the advertising display apparatus;

FIG. 5 is an elevational, partial cutaway sectional view along Line 5—5 of FIG. 4;

FIG. 6 is a partial cutaway sectional view along Line 6—6 of FIG. 4;

FIG. 7 is a partial cutaway perspective and exploded view of a transparent section;

FIG. 8 is a perspective view of a horizontally disposed tube embodiment of the advertising display apparatus; and, FIG. 9 is a perspective view of a leaf embodiment of the advertising display apparatus.

DESCRIPTION OF THE PREFERRED EMBODIMENT

Referring to FIG. 1, there is shown a perspective view of one of the preferred embodiments of the advertising display apparatus. Apparatus 10 comprises a substantially flat, rectangularly shaped base 14 having a top surface 15. Base 14 also comprises a plurality of condiment holding means or sections 16 which are separated from each other on either end of said base by advertising display means 20. Condiment holding means 16 can hold sugar, salt, pepper and the like. Obviously, any number of condiment holding sections can be provided depending upon the size of the base. Four short legs 9 are attached to bottom surface 11 of base 14.

Advertising display means 20 comprises means for displaying a plurality of advertisements, such as business cards 24, menus and the like, with each card facing in a different respective direction. Advertising display means 20 further comprises a single integral transparent cover means which protects the business cards. Cover means comprises a hollow, vertically disposed tube 12 having a rectangular horizontal cross-section (see FIG. 2). Tube 12 comprises a top end 28, a bottom end 30, a top piece 26 having a bottom surface 27, a bottom piece 34 having a bottom surface 35, and four (4) walls or side pieces 32. Bottom piece 34 and side pieces 32 form a solid integral unit. Top piece 26 is not permanently attached to tube 12 so that the support members 38 which hold the cards can be easily removed from tube 12 through top end 28. Each side piece 32 comprises an outer surface 31 and an inner surface 33. Alternatively, top piece 6 is permanently attached to top end 28 and bottom piece 34 is not permanently attached to bottom end 30. A long threaded rod is permanently attached at one end to the bottom surface 27 of top piece 26 by threading and gluing the rod end into a small plastic block which is attached to bottom surface 27. After the advertisements are placed in tube 12 through the bottom end, the tube is placed over and adjacent to bottom piece 34 and the opposite end of the rod is placed through a hole in the center of bottom piece 34. The rod extends out of the bottom surface of base 14. A nut is then used to tighten the rod to secure the tube to the bottom piece 34. The purpose of this alternate design is to make the tube tamper-proof to protect the advertisement.

Tube 12 is rotatably mounted to top surface 15 of base 14 so that the direction in which a given card faces may be changed. Mounting tube 12 to base 14 is accomplished by using a "lazy susan" device 17 which comprises an upper and lower piece of galvanized steel 19 and 21, respectively, which form a hollow tube 23 of a size adapted to permit a plurality of steel ball bearings 25 to freely rotate therein. Upper piece 19 is bolted to bottom surface 35 of bottom end 34, and the lower piece 21 is bolted to top surface 15 of base 14. Tube 12 is free to rotate about base 14 with a minimum of friction so that each side of tube 12 may be easily viewed at any desired position by the customer.

A plurality of support members, or display sections 38 comprise means for displaying a plurality of advertisements. Each support member is vertically disposed contiguous to a respective inside wall 33 of a side piece 32. Each support member 38 faces a different respective direction when in place in tube 12. Each support member 38 has an outside surface 40 and an inside surface 42; the outside surface 40 facing the inside wall 33 of a respective side piece 32. Three (3) cylindrical plastic ridge members 46 are glued to outside surface 40 of each support member 38, to form three (3) support sections 41 of a size adapted to permit a standard sized business card to "snap-fit" between any two ridge members. The cards may be removed and replaced with other cards without removing the remaining cards. A support ridge 36 is permanently glued to the top inside surface 33 of each side piece 32 to hold the top business card in place when a support member is in position, and to form a ledge around the inside perimeter of the top end of tube 12 for the support to top piece 26.

A small strip-like sheet of rigid but resilient plastic 44 is rolled into a tube and is of a size which when placed into the cavity of tube 12 normally expands between an expanded, open first condition and a second condition in which it is at least partially closed. The expansion is due to the inherent expanding force caused by rolling it into a tube. This expanding force simultaneously pushes, or urges, in an outwardly direction, against the inside surface 42 of each support member 38, thereby causing each support member 38 to press against the advertisement and inside wall 33 of each side piece 32. Thus, support members 38 stay in a fixed position against their respective side pieces until plastic sheet 44 is removed. While the length of tube 44 need only be long enough to permit a resonable expansion inside of tube 12, the height must be at least tall enough to press against the top third of the top support section 41 of each support member 38 to ensure that each support member is substantially contiguous against inside wall 33. The purpose of this design is to permit the removal of each support member as quickly as possible while preventing the support members from falling backward into the cavity of the tube 13. An alternate design could use slotted means (which is not shown in the drawing) which is attached to the inner walls of each side piece 38 to permit the insertion and removal of each support member 38.

Each support member 38 is approximately 6¼" long by 3½" wide and is made out of rigid plastic to ensure durability. Cardboard may be used in place of the plastic support members, however, in such a case each advertisement should be permanently glued thereto. If an advertiser wishes to use two or more support sections this can be easily accomplished by deleting one more support ridges 46 from a support member 38.

The apparatus is preferably constructed out of a transparent plastic material commonly known as "lucite" plastic. It may be assembled by gluing the individual pieces together, or it may be molded by conventional molding techniques into a one piece base and a one piece tube.

In the preferred embodiment of the apparatus, twelve cards are displayed at one time. Obviously, a longer tube 12 may be used to accommodate more cards; however, a four "tier" tube is the maximum desirable height and a two "tier" tube is the minimum desirable height.

Referring to FIG. 4, there is shown a perspective view of another preferred embodiment of the advertising display apparatus. This embodiment is commonly referred to as the "X" embodiment for the reason that the cover means has an "X" cross-section. The apparatus comprises a substantially flat, circularly-shaped condiment holding means 60 having four rectangularly-shaped radially disposed blocks 64 which are permanently attached to top surface 63 of holding means 60. Blocks 64 are disposed from a common, centrally located vertical axis 66, each block being at a 90 degree angle relative to the two adjacent blocks. A barrier guard 71 is attached to at one or more places on top surface 63 to prevent the various condiments from falling off holding means 60.

Cover means 68 is a one-piece transparent unit having four vertically disposed transparent sections 70; each section comprises two side pieces 72 which are joined at the distal end 73. Each side piece 72 extends radially from a centrally located vertically disposed axial portion 67. Each side piece 72 is separated from the other by a distance of approximately ¼ inches to permit the insertion therein of a support member 74 which is made out of rigid plastic or cardboard. Cover means 68 has a permanently attached top piece 76 which is glued to top end 69 of cover means 68. Bottom end 75 of each section 70 has an opening 77 to permit the insertion and engagement of block 64 when cover means 68 is mounted to the condiment holding means.

Each business card 78 is glued or otherwise affixed to each side of each support member 74 at equally spaced distances. Three cards are attached to each side of support member 74. Each support member 74 is inserted into bottom end opening 77 of each transparent section 70. After each support member is placed into its respective transparent section 70 the entire "X" unit is engaged with blocks 64 to fix the position of cover means 68. Holding means 60 is rotatably mounted to a base 65 using a "lazy susan" device which is similar in function to the ball bearing device previously described for the "tube" embodiment. Screw 80 is used to attach cover means 68 to holding means 60. This mounting arrangement causes holding means 60 and cover means 68 to rotate simultaneously about base 65.

A third embodiment of the advertising display apparatus is shown in FIG. 8. Tube 90 is constructed substantially identical to tube 12 shown in FIG. 1. This tube, however, is rotatably mounted in a horizontal position to condiment holding means 92 by means of a long screw 94. The placement and positioning of the support members and business cards into tube 90 is similar to the procedure used in the "tube" embodiment.

A fourth embodiment of the advertising display apparatus is shown in FIG. 9. In this embodiment, a plurality of transparent sections 102 are each rotatably mounted at their end portion to support structure 104 about a vertically disposed pin 106. One end of pin 106 is rotatably mounted to support structure 104, and the other end is rotatably mounted to condiment holding means 108. Each transparent section 102 is hollow to permit the insertion therein of support members 108 which have business cards 110 attached to both sides thereof.

A fifth embodiment of the advertising display apparatus which is not disclosed in the drawing is the "Y" embodiment. The "Y" embodiment is identical in every aspect to the "X" embodiment except that the cross-sectional of the transparent cover means is in the shape of a "Y".

A sixth embodiment of the advertising display apparatus which is not disclosed in the drawing is the "cylindrical" embodiment. In this embodiment the advertising display means is in the shape of a hollow, vertically disposed cylinder which is rotatably mounted to condiment holding means as described in the description of the "tube" embodiment. The area of the inside surface of the cylinder is of a size adapted to permit four support members to be placed adjacent thereto. Slotted means along the perimeter of the bottom and top ends of the cylinder permit the bottom and tope ends of each support member to be inserted therein.

Referring to FIG. 1, the size of base 14 is approximately 12" long by 5-15/16" wide although the use of condiment holding sections is optional. Additionally, the size of tube 12 is approximately 4" square by 6¾" high, but it also may function adequately by showing two cards per side to four cards per side rather than three cards per side. Obviously, the size and height of the tube may vary according to the available area on which the display apparatus is used.

In the "X" embodiment, the condiment holding member has a diameter of approximately 8" and the transparent cover has a diameter of approximately 7⅞". The height of the transparent cover is approximately 6¾" and each support member holds six (6) cards.

In the preferred embodiment of the apparatus, individual business cards are used. One may use, however, other suitable advertising means, such as a single card of a size adapted to fit onto the entire area of one side of the support member.

The apparatus is reusable, lightweight, easily cleaned, simple in design and economical to manufacture.

The foregoing description and drawing merely explains and illustrates the invention and the invention is not limited thereto, except insofar as the independent claims are so limited is those who are skilled in the art and have the disclosure before them will be able to make modifications and variations therein without departing from the scope of the invention.

What is claimed is:

1. In combination:

a base;

means on said base for holding condiments;

a plurality of support members on said base, each support member facing in a different respective direction;

means for mounting at least one advertisement on each of said support members;

means mounting said support members for movement relative to said base to change the direction in which a given advertisement faces;

a hollow, transparent tube having a plurality of walls and constituting transparent cover means for enclosing and protectively covering said support members;

each support member and its respective advertisement facing a respective wall on said transparent tube; and, a resilient, strip-like member located within said tube and resiliently deformable between an expanded, open first condition and a second condition in which said strip-like member is at least partially closed for urging the advertisment on each support member toward its respective wall on the transparent tube.

2. In the combination of claim 1:

means removably mounting said cover means relative to said support members.

3. In the combination of claim 1 wherein each support member comprises:

a plurality of display sections each comprising means for displaying an advertisement facing in the same direction.

4. In the combination of claim 1 wherein said condiment holding means comprises:

a plurality of condiment holding sections separated from each other by said tube.

5. In the combination of claim 1 wherein each support member comprises:

means for removably mounting said advertisements.

6. In the combination of claim 1 wherein:

said support members are vertically disposed each facing in a different respective direction;

means on each of said support members for mounting a plurality of advertisements, one above the other; and, a vertically disposed, transparent cover means for protectively covering the advertisements on all of said plurality of support members.

7. In the combination of claim 6 wherein:

said transparent cover means is a single integral member.

8. In the combination of claim 6 wherein:

one of (a) said cover means and (b) a support member is removable relative to the other.

9. In the combination of claim 6:

said cover means comprises a tube having a rectangular horizontal cross-section;

said plurality of support members are disposed on the inside of said tube, there being one support member facing each of the four walls of said tube;

said mounting means for the advertisements comprises means for mounting said advertisements between a respective support member and the corresponding tube wall toward which said support member faces; and said strip-like member normally urging each of said support members towards its correspondent tube wall.

10. In the combination of claim 9 wherein:

each support member has an outside surface, facing its corresponding tube wall, and an inside surface; and, said strip-like member comprises means pressing outwardly against the inside surface of each support member.

11. A combination as recited in claim 1 wherein said support members are separate and discrete from said resilient strip-like member and each support member is located between said resilient strip-like member and a respective wall on the transparent tube.

12. A combination as recited in claim 4 wherein:

said resilient strip-like member has a substantially cylindrical configuration when it is in its second condition.

13. A combination as recited in claim 12 wherein:

said hollow tube has a polygonal configuration; and, a support member faces each side of the polygon.

14. In combination:

a base;

means on said base for holding condiments;

a plurality of support members on said base, each support member facing in a different respective direction;

means for mounting at least one advertisement on each of said support members, said advertisement mounted thereon;

means mounting said support members for movement relative to said base to change the direction in which a given advertisement faces;

a vertically disposed transparent cover means for protectively covering the advertisements on all of said plurality of support members;

a plurality of support members arranged in a radial disposition from a common, centrally located axis, each support member extending at a 90 degree angle relative to the two adjacent support members;

said transparent cover means comprising a plurality of transparent sections each protectively covering a respective one of said support members;

said transparent sections extending radially from a centrally located, vertically disposed axial portion;

means detachably mounting said cover means on said condiment holding means;

means mounting said condiment holding means for rotation about said vertical axis, relative to said base; and, said means mounting said display means comprising means for securing together said support members, said transparent cover sections, and said condiment holding means for rotation about said vertical axis, relative to said base, as a unit.

15. In the combination of claim 14 wherein:

one of (a) said cover means and (b) said support members is removable relative to the other when the cover means is detached from said condiment holding means.

16. In the combination of claim 14 and comprising:

means on said condiment holding means for engaging each of said vertically disposed transparent cover sections, at the bottom of said section, to fix the position of said cover sections on the condiment holding means.

* * * * *